United States Patent [19]

Schniter

[11] 4,353,393

[45] Oct. 12, 1982

[54] SELECTIVE SHUTOFF FOR REPETITIVELY OPERATED VALVE

[75] Inventor: Jorg Schniter, Glenview, Ill.

[73] Assignee: R. R. Donnelley & Sons Company, Chicago, Ill.

[21] Appl. No.: 245,531

[22] Filed: Mar. 19, 1981

[51] Int. Cl.[3] ..... F16K 31/524

[52] U.S. Cl. ..... 137/624.2; 74/829; 74/586; 137/624.12; 137/625.25; 271/108

[58] Field of Search ..... 74/829, 830, 586; 137/624.12, 624.2, 625.25; 271/108

[56] References Cited

U.S. PATENT DOCUMENTS

| | | | |
|---|---|---|---|
| 230,470 | 7/1880 | Clerk . | |
| 2,948,274 | 8/1960 | Wood | 123/198 |
| 3,875,810 | 4/1975 | Paramonoff | 74/55 |
| 3,880,418 | 4/1975 | Swanson | 270/54 |
| 3,965,772 | 6/1976 | Hamisch, Sr. | 74/586 |
| 4,133,332 | 1/1979 | Benson et al. | 123/198 |

*Primary Examiner*—Gerald A. Michalsky
*Attorney, Agent, or Firm*—Wegner, McCord, Wood & Dalton

[57] ABSTRACT

A vacuum system for operating a member, such as a signature gripper of a collator which must be actuated and released at regular intervals, conventionally has a slide-type valve which is constantly reciprocated by a cam-operated pushrod between an open position to connect the member to vacuum and a closed position to isolate the member from vacuum. To selectively disable and enable the gripper for selective feed of signatures, an air cylinder and piston unit is used as part of the pushrod so the length of the pushrod may be changed by retracting or extending the air cylinder piston. When the piston is retracted the valve is reciprocated between an open and a normal closed position; while extension of the piston causes the valve to be reciprocated between the normal closed position and a second closed position.

7 Claims, 5 Drawing Figures

16
17
12
13
19
10
21
15
14
18
42
43
21a
41
23
40
20
39
32
33
30
31
11
34
26a
27
35
26
36
26
24
37
38
25

16
17
10
19
12
14
15
18
42
43
41

15
17
19
10
12
14
16
18
42
43
41

16
17
10
19
12
14
15
18
43
42
41

SELECTIVE SHUTOFF FOR REPETITIVELY OPERATED VALVE

BACKGROUND OF THE INVENTION

There are various mechanisms in which a member must be actuated at regular intervals, but must be capable of being selectively disabled and enabled to eliminate the regular actuation of the member when desired. One such mechanism is a collator for printed signatures, in which a signature gripper at each of the collator supply boxes is normally actuated at regular intervals to feed signatures seriatim to the traveling signature gathering belt or saddle. The increasing popularity of demographic editions of periodicals, and the need to publish catalogs which contain many pages applicable to all parts of the country and other pages applicable only to certain regions, has made it necessary to develop collators in which certain signature grippers are selectively disabled and enabled in order that the collator may receive signatures fed by those grippers only when desired.

Collator grippers commonly are suction members which are oscillated to contact a signature at the bottom of a supply box while under vacuum and to swing away, pulling the signature which is then freed by release of the vacuum. Both the mechanical oscillation of the grippers and the regular actuation and release of the suction are accomplished by mechanisms which are a part of the collator drive, to eliminate timing problems. The vacuum control valve ordinarily is moved between an open position placing the grippers under vacuum and a closed position eliminating vacuum at the grippers by rotation of a cam shaft which is operated by the collator drive.

There has, for many years, been a need for a simple apparatus to selectively eliminate the regular connection of the grippers to suction, so that even though the grippers continue to oscillate they cannot feed signatures.

A mechanism which is capable of disabling and enabling the vacuum grippers of a collator is equally applicable to other mechanisms where a member which must be actuated at regular intervals needs to be selectively disabled and enabled.

SUMMARY OF THE INVENTION

In accordance with the present invention, a link which is operatively connected to a valve element for regularly moving the element between open and closed positions is provided with means for selectively disabling and enabling the valve element by inserting in the link a member which has first and second relatively movable parts for changing the length of the link between a first length in which the valve element is moved between open position and a normal closed position, and a second length in which the valve element is moved between the normal closed position and a second closed position. Means are provided for selectively moving the parts relative to one another to change the length of the link while the system is in operation.

In a preferred embodiment of the invention, the member which is inserted in the link is a fluid cylinder and piston unit, and the means for selectively changing the length of the link comprises fluid supply means for moving the piston between a retracted position and an extended position.

The present invention provides a very simple and inexpensive way of enabling and disabling a device which must be actuated and released at regular intervals.

THE DRAWINGS

DETAILED DESCRIPTION OF THE INVENTION

The following detailed description and the accompanying drawing describe the best mode known to applicant for carrying out his invention.

Referring to FIGS. 1 and 2, 10 and 11 are parts of a collator frame which support parts of the vacuum system for operating signature grippers (not shown), and of the mechanism for operating vacuum control valves, indicated generally at 12, which are mounted upon the frame member 10.

Figure 1:
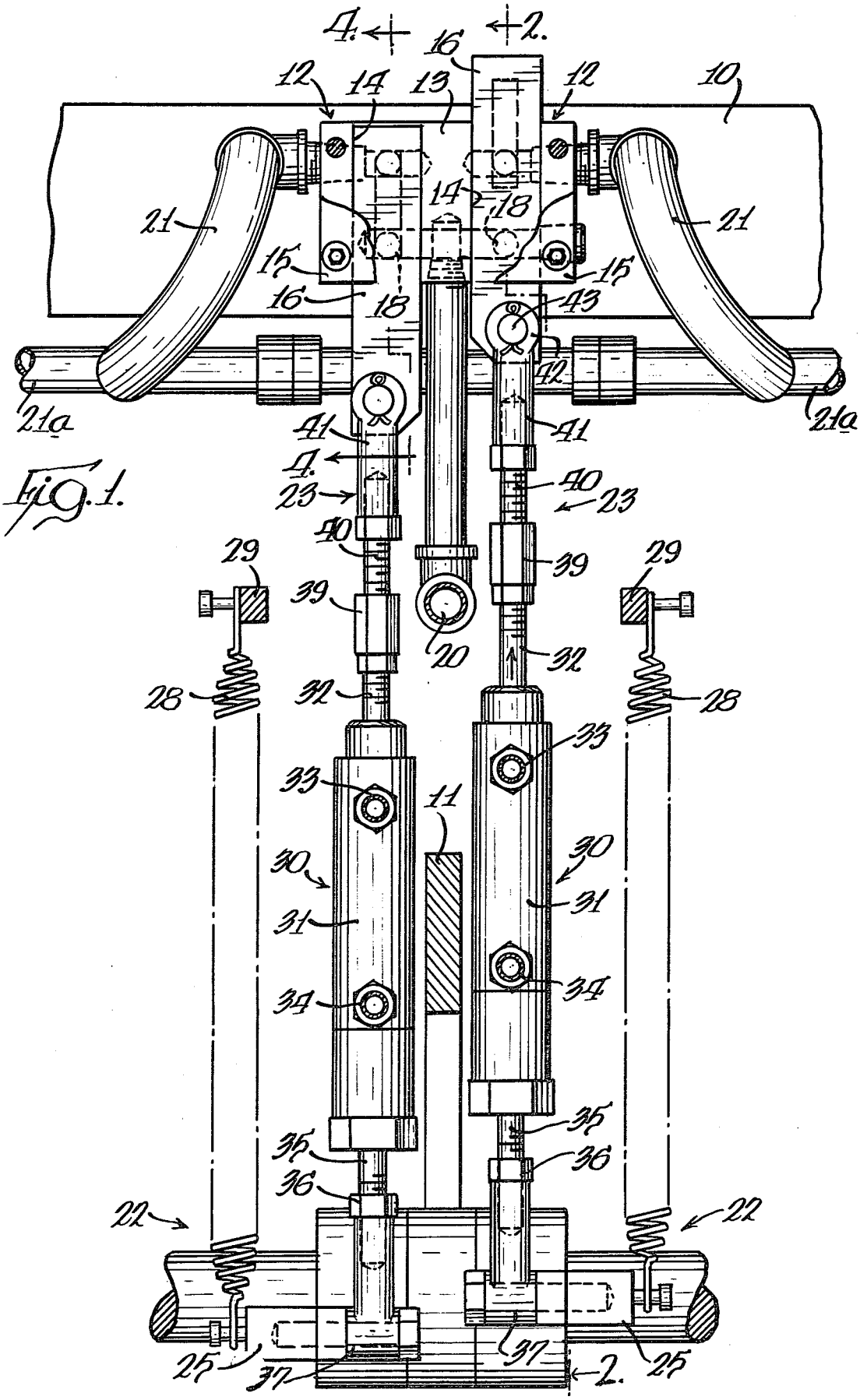
FIG. 1 is a front elevational view, partly in section, of apparatus embodying the invention.
Figure 2:
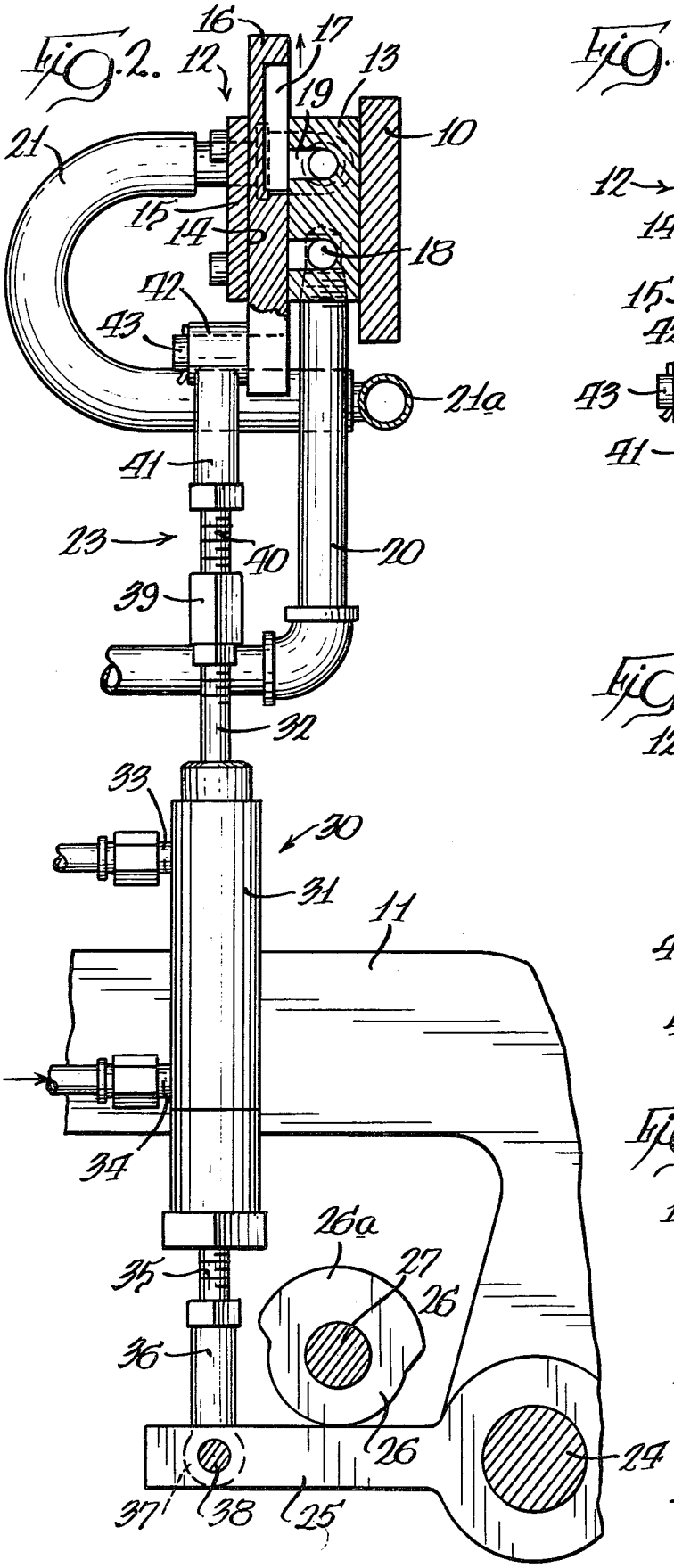
FIG. 2 is a longitudinal sectional view taken substantially as indicated along the line 2—2 of FIG. 1, and showing the vacuum valve in its second closed position.
Figure 4:
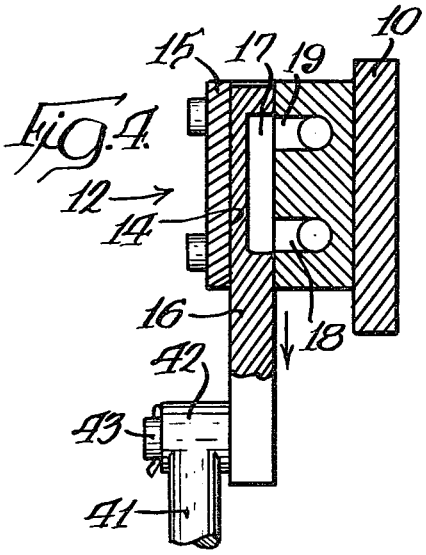
FIG. 4 is a fragmentary sectional view taken substantially as indicated along the line 4—4 of FIG. 1, illustrating the vacuum control valve in its open position.

Referring particularly to FIG. 2, each of the vacuum control valves 12 consists of a body 13 having a long, narrow channel 14 which is open at both ends. Conveniently the channel 14 is formed in a surface of the valve body and is covered by a face plate 15 which seals the channel except at its two ends. A valve element 16 is reciprocable lengthwise in the channel and has an elongate groove 17 in the face opposite the face plate 15. Communicating with the valve channel 14 at the side opposite the face plate 15 are an inlet port 18 and an outlet port 19 which are positioned side by side along the length of the channel and which are spanned by the valve element groove 17 in the open position of the valve illustrated in FIG. 4. As shown by FIG. 1, a single valve body 13 has parallel channels 14 which are covered by a single face plate 15.

A vacuum conduit 20 connects the two valve inlet ports 18 to a vacuum system; while hoses 21 connect the outlet ports 19 to pipes **21*a*** which connect with the suction grippers of two adjacent collator boxes.

Endwise reciprocation of each of the valve elements 16 is produced by a continuously operating mechanical valve actuator means, indicated generally at 22, which includes an operating link in the form of a pushrod, indicated generally at 23.

Supported in the machine frame 11 is a rod 24 upon which a cam follower 25 is rotatably mounted; and the cam follower is maintained in contact with a cam 26 on a cam shaft 27 by a tension spring 28 which has one end connected to a spring pin on the cam follower and the other end connected to a spring pin on a frame member 29.

Each of the links 23 consists of an air cylinder and piston unit, indicated generally at 30, which includes a cylinder 31 with a piston having a piston rod 32, a rod end air inlet nipple 33 and a cylinder air inlet nipple 34.

A threaded mounting rod 35 on the end of the cylinder 31 screws into a coupling 36 at the lower end of which is a hollow boss 37 pivotally mounted on a cam follower pin 38. The piston rod 32 is threaded to receive a threaded coupler 39 to which an adjustment screw 40 is also connected, and the adjustment screw 40 in turn screws into a coupler 41 at the end of which is a hollow boss 42 which is pivoted upon a pin 43 that extends forwardly from the lower end of the valve element 16.

Figure 5:
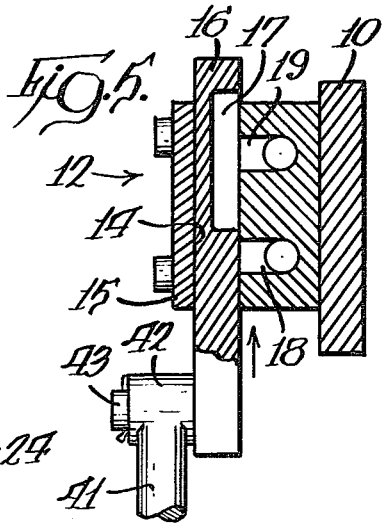
FIG. 5 is a view like FIG. 4 illustrating the vacuum control valve in its normal closed position.

The length of the links is so adjusted that when a cam 26 is in the position illustrated in FIG. 2 and the valve 12 is in regular operation, the tension spring 28 locates the valve element 16 in the normal closed position illustrated in FIG. 5, in which the outlet port 19 is isolated from the inlet port 18. In regular operation the piston and rod 32 are retracted; and when rotation of the cam shaft 27 brings a cam lobe 26*a* against the cam follower 25 the valve element 16 is moved downwardly from the closed position of FIG. 5 to the open position of FIG. 4.

Figure 3:
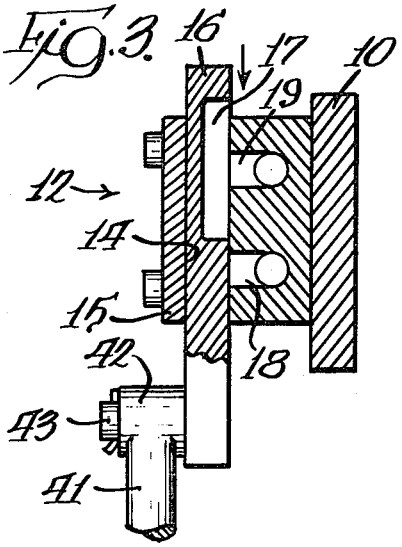
FIG. 3 is a view like FIG. 2 illustrating the vacuum control valve moving from the second closed position to a first closed position.

When a vacuum control valve 12 is to be disabled, air is admitted to the cylinder 31 through the nipple 34 to extend the piston and piston rod 32 as indicated by the arrow on the rod at the right side of FIG. 1; and with the piston rod so extended and the cam 26 in the position illustrated in FIG. 2, the spring 28 holds the valve element 16 in the second closed position illustrated in FIG. 2. When rotation of the cam shaft 27 brings the cam lobe 26*a* against the cam follower 25 the valve element 16 is moved downwardly, as indicated by the arrow in FIG. 3, to a position equivalent to the normal closed position of FIG. 5. Accordingly, with the piston rod 32 extended the cam 26 merely reciprocates the valve member 16 between the two closed positions seen in FIGS. 2 and 3, thereby disabling the suction gripper.

The foregoing detailed description has been given for clearness of understanding only, and no unnecessary limitations should be understood therefrom as modifications will be obvious to those skilled in the art.

I claim:

1. In a fluid system for operating a member which must be actuated at regular intervals and which must be selectively disabled and enabled, said system including a valve with a body having a fluid inlet port and a fluid outlet port, and a valve element in said body which is movable between an open position permitting fluid to flow from the outlet port through the inlet port and a closed position blocking the flow of fluid between said ports, and a continuously operating mechanical valve actuator means including a link operatively connected to the valve element for regularly moving said element between said open and closed positions, means for selectively disabling and enabling said valve element, said means comprising, in combination:

a member in said link having first and second relatively movable parts for changing the length of the link between a first length in which the valve element is moved between open position and a normal closed position and a second length in which said valve element is moved between said normal closed position and a second closed position;

and means for selectively moving said parts relative to one another to change the length of said link while the system is in operation.

2. The combination of claim 1 in which the member in the link is a fluid cylinder and piston unit, and the means for selectively changing the length of the link comprises fluid supply means for moving the piston between a retracted position and an extended position.

3. The combination of claim 1 or 2 in which the valve body contains a long, narrow channel, the inlet port and the outlet port are side by side along the length of said channel, the valve element is reciprocable lengthwise in said channel, the link is a pushrod, and the continuously operating mechanical valve actuator moves said pushrod endwise.

4. The combination of claim 3 in which the continuously operating mechanical valve actuator comprises a rotating shaft and cam means on said shaft for moving the pushrod.

5. The combination of claim 1 or 2 in which the continuously operating mechanical valve actuator comprises a rotating shaft and cam means on said shaft for moving the links.

6. The combination of claim 1 or 2 in which the fluid system is a vacuum, the valve body has a long, narrow channel open at both ends, the inlet port is connected to vacuum, and the inlet and outlet ports are side by side along the length of said channel, the valve element is reciprocable lengthwise in said channel and has a groove which spans the inlet and outlet ports in open position and which connects the outlet port to the atmosphere in the normal closed position and in the second closed position, the link is a pushrod, and the continuously operating mechanical valve actuator moves said pushrod endwise.

7. The combination of claim 6 in which the continuously operating mechanical valve actuator comprises a rotating shaft and cam means on said shaft for moving the pushrod.

* * * * *